US007360482B2

(12) United States Patent
Deng

(10) Patent No.: US 7,360,482 B2
(45) Date of Patent: Apr. 22, 2008

(54) CRANK ROLLER PAPER CUTTING DEVICE

(76) Inventor: Yeqing Deng, No. 21, Zihua Road, Jinhu Garden, Dongcheng District, Dongguan City, Guangdong 523115, Dongguan City (CN)

( * ) Notice: Subject to any disclaimer, the term of this patent is extended or adjusted under 35 U.S.C. 154(b) by 158 days.

(21) Appl. No.: 11/336,445

(22) Filed: Jan. 20, 2006

(65) Prior Publication Data

US 2006/0219077 A1 Oct. 5, 2006

(30) Foreign Application Priority Data

Jan. 20, 2005 (CN) ..... 2005 1 0032847

(51) Int. Cl.
*B30B 3/04* (2006.01)

(52) U.S. Cl. ..... 100/176; 100/155 R; 100/282; 100/292

(58) Field of Classification Search ..... 100/76, 100/121, 155 R, 161, 172, 173, 176, 280, 100/282, 288, 292; 68/97, 98, 99, 244; 271/272, 271/273; 269/21, 95; 248/362, 363
See application file for complete search history.

(56) References Cited

U.S. PATENT DOCUMENTS

| | | | | |
|---|---|---|---|---|
| 756,902 | A | 4/1904 | Shoemaker | |
| 896,478 | A | 8/1908 | Stockman | |
| 1,090,914 | A * | 3/1914 | Guettler | 225/94 |
| 1,453,405 | A | 5/1923 | Platt | |
| 1,658,823 | A | 2/1928 | Willard | |
| 1,992,250 | A | 2/1935 | Stacey | |
| 2,005,340 | A | 6/1935 | Jaffin | |
| 2,019,009 | A | 10/1935 | Hendrix | |
| 2,029,567 | A | 2/1936 | Hough | |
| 2,112,011 | A | 3/1938 | Byerlein | |
| 2,245,770 | A | 6/1941 | Franzmann | |
| 2,260,183 | A | 10/1941 | Leslie | |
| 2,458,867 | A | 1/1949 | Messersmith | |
| 2,595,970 | A | 5/1952 | McGill | |
| 2,612,123 | A | 9/1952 | Nord | |
| 2,619,173 | A | 11/1952 | Crain | |

(Continued)

FOREIGN PATENT DOCUMENTS

| | | |
|---|---|---|
| JP | 04-217497 | 8/1992 |

(Continued)

*Primary Examiner*—Jimmy T. Nguyen
(74) *Attorney, Agent, or Firm*—Morriss O'Bryant Compagni, P.C.

(57) ABSTRACT

This invention reveals a crank roller paper cutting device, which comprises a base, a supporter, a handle part, a master roller, a slave roller, and a group of speed-reducing gears. Via the group of speed-reducing gears, handle part correlates to the master roller and slave roller at one terminal, both of the master roller and slave roller are captured by the open bores therewith on the supporter. While the other ends of master roller and slave roller are suspended in the air, where a removable positioning block is attached. Upon the above said positioning block, there are two open bores or blink holes in correspondence to the master roller and slave roller respectively. Around the master roller and slave roller are many removable regulating cylinders, or one regulating cylinder in different thickness. This crank roller paper cutting device is reasonable in design, easy to use and safe in operation for a wide range of applications, particularly valuable for kindergarten enlightenment education.

21 Claims, 3 Drawing Sheets

U.S. PATENT DOCUMENTS 2,625,908 A 1/1953 Knott
2,641,781 A 6/1953 Haskell
2,703,023 A 3/1955 Sarno
2,791,029 A 5/1957 Leo
2,821,871 A 2/1958 Sarno
2,876,575 A 3/1959 Leika
2,885,933 A 5/1959 Phillips
2,967,562 A * 1/1961 Orchard ..... 100/176
3,064,559 A 11/1962 Treer
3,094,091 A 6/1963 Peccerill
3,170,358 A 2/1965 Martin
3,182,530 A 5/1965 Scott et al.
3,228,263 A 1/1966 Bien
3,250,163 A 5/1966 Smith
3,261,044 A 7/1966 Hoff
3,266,358 A 8/1966 Cox et al.
3,383,969 A 5/1968 Saunders
D211,608 S 7/1968 Gray
3,400,625 A 9/1968 Wrona
3,531,863 A 10/1970 Sandborn
3,534,440 A 10/1970 Roberts
3,587,382 A 6/1971 Boyd
3,593,659 A * 7/1971 Brackett ..... 101/143
3,667,334 A 6/1972 Brunett
3,744,384 A 7/1973 Jarritt et al.
3,863,550 A 2/1975 Sarka et al.
3,926,032 A 12/1975 Brooks et al.
3,935,811 A 2/1976 Lenz et al.
3,986,447 A 10/1976 Zimmer
4,052,886 A 10/1977 Buick
4,065,990 A 1/1978 Edhlund
D257,777 S 1/1981 Eichenberg et al.
4,334,469 A * 6/1982 Tanner et al. ..... 100/110
4,345,516 A 8/1982 Sinclair
4,444,075 A 4/1984 Mulry
4,462,291 A 7/1984 Schulz
4,537,546 A 8/1985 Lucas
4,542,691 A 9/1985 Kokrhanek
4,625,592 A 12/1986 Bayens
4,638,731 A 1/1987 Kato
4,692,198 A 9/1987 Borresen
D296,565 S 7/1988 Eichenberg et al.
4,761,988 A 8/1988 Kato
4,763,551 A 8/1988 Halff et al.
4,818,207 A 4/1989 Heron
4,979,613 A 12/1990 McLaughlin et al.
4,981,061 A 1/1991 Hillock et al.
D319,771 S 9/1991 Reid et al.
5,054,389 A 10/1991 Kuhlman et al.
5,112,423 A 5/1992 Liebe, Jr.
5,129,157 A 7/1992 Wood
5,135,533 A 8/1992 Peterson et al.
5,140,872 A 8/1992 Holliday et al.
5,172,622 A 12/1992 Sabin
5,181,464 A 1/1993 Kuhlman et al.
5,188,026 A 2/1993 Fuqua et al.
5,230,156 A 7/1993 Patenaude
5,255,587 A 10/1993 Eichenberg et al.
D341,842 S 11/1993 Eichenberg et al.
5,275,076 A 1/1994 Greenwalt
5,368,672 A 11/1994 Gunzelman et al.
5,383,996 A 1/1995 Dressler
D359,967 S 7/1995 Eichenberg et al.
5,544,576 A 8/1996 Kato
5,579,582 A 12/1996 Carlson
5,590,910 A 1/1997 Meth
5,628,226 A 5/1997 Weissman
D380,488 S 7/1997 Elstad et al.
5,660,105 A 8/1997 Benson et al.
D384,572 S 10/1997 Ongaro
5,722,319 A 3/1998 Hirano
5,775,213 A 7/1998 Hyde
5,778,748 A 7/1998 Beijen
5,961,779 A * 10/1999 Bradshaw ..... 156/495
6,170,376 B1 1/2001 Strobel et al.
6,543,131 B1 4/2003 Beroz et al.
6,626,965 B2 9/2003 Workman et al.
6,658,978 B1 12/2003 Johnson
6,739,244 B1 5/2004 Carbaugh
6,983,635 B2 * 1/2006 Rockholt ..... 72/428
2004/0118304 A1 6/2004 Corcoran et al.
2005/0028644 A1 2/2005 Hughes
2005/0045522 A1 3/2005 Corcoran
2005/0050936 A1 3/2005 Hughes et al.
2005/0056166 A1 3/2005 Corcoran et al.
2005/0061168 A1 3/2005 Corcoran et al.
2005/0211041 A1 9/2005 Oh
2005/0215405 A1 9/2005 Corcoran
2005/0253324 A1 11/2005 Corcoran et al.
2005/0268761 A1 12/2005 Corcoran et al.

FOREIGN PATENT DOCUMENTS

JP 11-034184 2/1999
JP 2000-127095 5/2000
WO WO 03/016035 2/2003

* cited by examiner

CRANK ROLLER PAPER CUTTING DEVICE

FIELD OF THE INVENTION

This invention relates to an image cutting device, more particularly, a crank roller paper cutting device.

DESCRIPTION OF THE PRIOR ART

Traditionally, paper-cut artwork is a popular, diverse and highly enjoyable art form for many persons, especially for children in early stage studies. Outside China, there are many countries having employed this kind of art for child learning. For example, in Unite States, people usually apply paper sheet, plastic, rubber or similar materials to cut into letters, cartoons, animals or human beings to train perception and distinction of the babies. However, traditional handmade image products are lower in efficiency and poorer in coincidence without the capability for mass production. In order to overcome such deficiency, people invented a new method for large scale production by manufacturing an image cutter initially. They bent a thin and sharp blade into an image shape and then fix it onto a piece of wood. Later, they apply this cutter consequently to paper sheet or some other flat materials to produce identical images. If they'd like to generate another image product, just change to a different cutter, as P.R. China Utility PATENT NO. 01209608.3 disclosed. China Utility Patent No. 200420071603.2 disclosed another image, cutter. Even though this type of image cutter can produce flat image manually, the operation is laborious and intensive, and easy to cause unevenness on press (that is, different parts on the flat material receive different pressures). In regard to mechanical operation associated with such image cutter, an US invention U.S. Pat. No. 6,619,195 reveals a type of paper cutting device, as FIG. 1 shows (from American Patent Publication), by attaching a pressing component to the image cutter in order to cut images via the force of leverage. Such device, however, inherits defects below: 1) not safe in operation. Internal structure of the device is exposed to air without any cover. People incline to hurt himself in case of putting finger or other part accidentally under the pressing block in time of pressing the leverage. 2) huge in size. Since the device needs a longer arm for the leverage, it is larger in size and inconvenient for package, storage or transportation. Another patent from China, No. 03317878.X, discloses a type of "roller paper cutting device", as FIG. 2 shows, which comprises of a master roller connected to a handy wheel and a slave roller fixed on the base. Image cutter can be put into the space between the two rollers: and cut the images subsequently. This roller paper cutting device is convenient in operation and smaller in size, but it possesses obvious deficiency too: space between these two rollers, the master and slave, is difficulty to change, so it is fit only for the image cutter with the same thickness, not for all image cutters. Therefore, applications of this device are limited. Besides, since it acquires driving force directly from the handy wheel on the master roller without the help of speed reducing gears, rotating force is necessarily high indeed, not suitable for children or other weak persons.

SUMMARY OF THE INVENTION

It is, therefore, the objective of this invention to provide a reasonable, simple structured, labor saving and easy-to-use crank roller paper cutting device to overcome imperfectness of contemporary technologies, in conjunction with image cutters in a variety of thickness.

This objective is achieved by employing technique as follows: this crank roller paper cutting device comprises a base, a supporter, a handle part, a master roller and a slave roller, wherein it also includes a group of speed reducing gears. Via this group of speed-reducing gears, handle part correlates to the master roller and slave roller at one terminal. Both of the master roller and slave roller are captured by the open bores therewith on the supporter. While the other ends of master roller and slave roller are suspended in the air, where a removable positioning block is attached. Upon the above said positioning block, there are two open bores or blink holes in correspondence to the master roller and slave roller respectively. Around the master roller and slave roller are multiple layer removable regulating cylinders or one regulating cylinder in different thickness.

The group of speed reducing gears consists of a first gear, which is relatively fixed in connection with handle parts, and a two-scale second gear, which is relatively sliding in connection with the master roller, a two-scale third gear, which is relatively fixed in connection with the master roller, a two-scale fourth gear, which is relatively sliding in connection with the slave roller, and a fifth gear, which is relatively fixed in connection with the slave roller. The first gear is snapped with the big scale one of the second gear, whose small one is, in turn, snapped with the big scale one of the fourth gear. While the small scale one of the fourth gear is subsequently snapped with the big one of the third gear, whose small one, in succession, is snapped with the fifth gear.

The supporter consist of two parallel supporting plates. Upon the tow parallel supporting plates, there are four open bores matched with each other in two pairs. The master roller and slave roller pierce through the open bores on the two supporting plates and are kept parallel in level, perpendicularly to the supporting plates.

The portion of master roller and slave roller that is hung in the space between the two parallel supporting plates is held by positioning rings or protruding tables.

The two parallel supporting plates have rotating bearings mounted inside the four bores.

The handle part is made up of a handy wheel or handy stick.

The positioning block, which is in correspondence to the master roller and slave roller, has rotating bearings mounted inside the open bores or blind holes.

The multiple layer regulation cylinders are made up of a series of same length but different diameter cylinders inserted one by another. Each cylinder is joined with each other in sequence.

The single cylinder in different thickness constitutes a series of regular cylinders. Once applied with an image cutter with certain thickness, just select a cylinder in the same thickness and put on to the master roller or slave roller. In case of using another image cutter, merely change to another cylinder in different thickness.

The regular cylinder (the press cylinder which contacts the blade of the image cutter) is made of non-rigid materials with certain hardness, such as plastic PP, PC, ABS, AS or nylon 66. The purpose of this is to avoid damage to the blade while pressing the image cutter properly.

The base has suckers on the bottom side. The suckers keep the device stuck to the operation table without much movement so as to insured the device functions normally. The suckers can be made of plastic (i.e., PVC) or rubber.

Principle of this invention is: wheeling the handle part by hand, the master roller and slave roller are rotated in reverse directions driven by the group of speed reducing gears. Place the image cutter inside the space between these two rollers and the image cutter shall be carried rolling over the rollers. Squeezed by the master roller as well as the slave roller, the image cutter scissors the inside flat material into a shape of the blade, such as, for example, a letter, carton, animal or human image.

Compared with contemporary technology, this invention is characterized with following advantages and effects: 1) easy in operation: this crank roller paper cutting device employs a group of gears as driving force with lager powers. Its impact is little, operation is stable, and laboriousness is less. Hence, it is convenient especially for children with weak strength. 2) safe in use: this device acts slowly without any large impact on people and can avoid accidental injury to users effectively. 3) wide in application: quantity and sizes of regulation cylinders can be changed simply in line with different image cutters. Many image cutters can be adapted by the same device. Thus, this device is more flexible in application. 4) reasonable in structure: this device is compact in structure and smaller in size. It is expedite for package, storage and transportation, and particularly valuable for families to enlighten their kids.

BRIEF DESCRIPTION OF TEE DRAWINGS

DETAILED DESCRIPTION OF THE EMBODIMENT

Following is a detailed description about the invention based on example with drawings.

EXAMPLE 1

Figure 1:
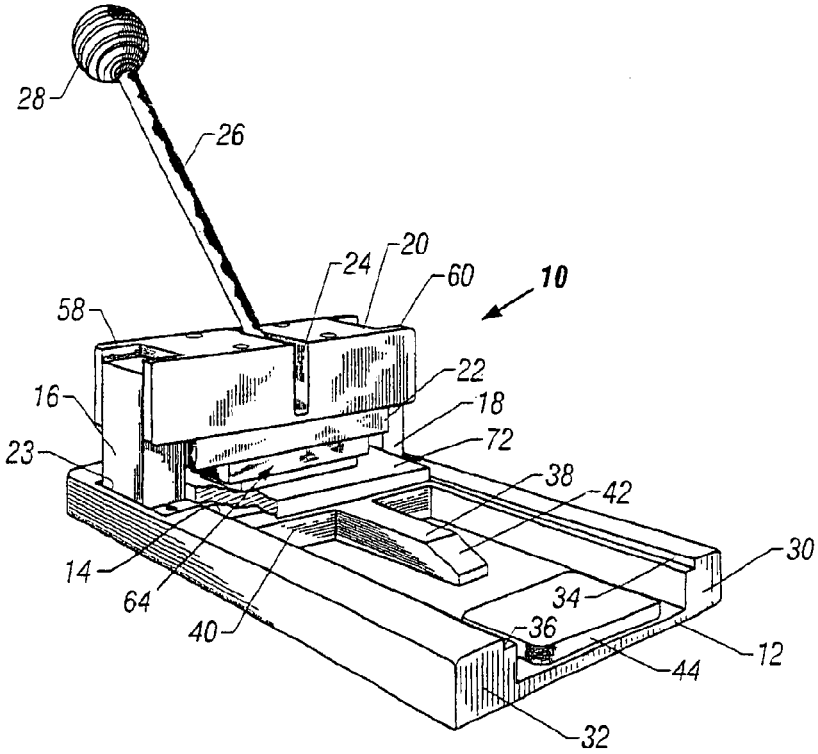
Fig. 1 (Prior art)
FIG. 1 is a sketch showing the structure of a type of contemporary leverage paper cutting device.
Figure 2:
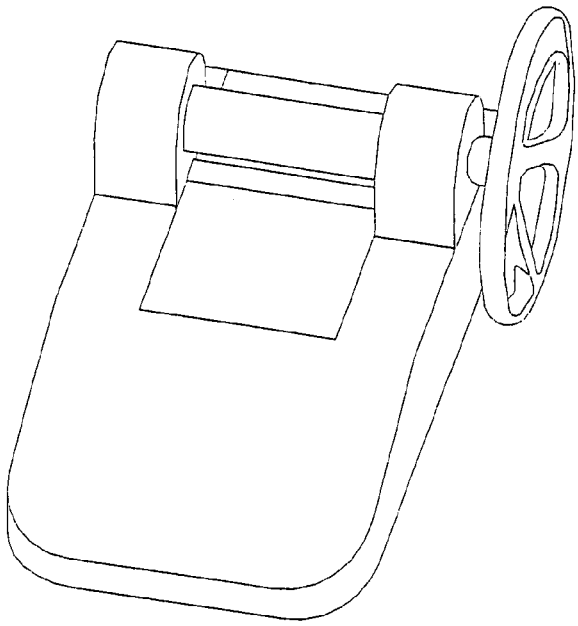
Fig. 2 (Prior art)
FIG. 2 is a sketch showing the structure of a type of contemporary roller paper cutting device.
Figure 3:
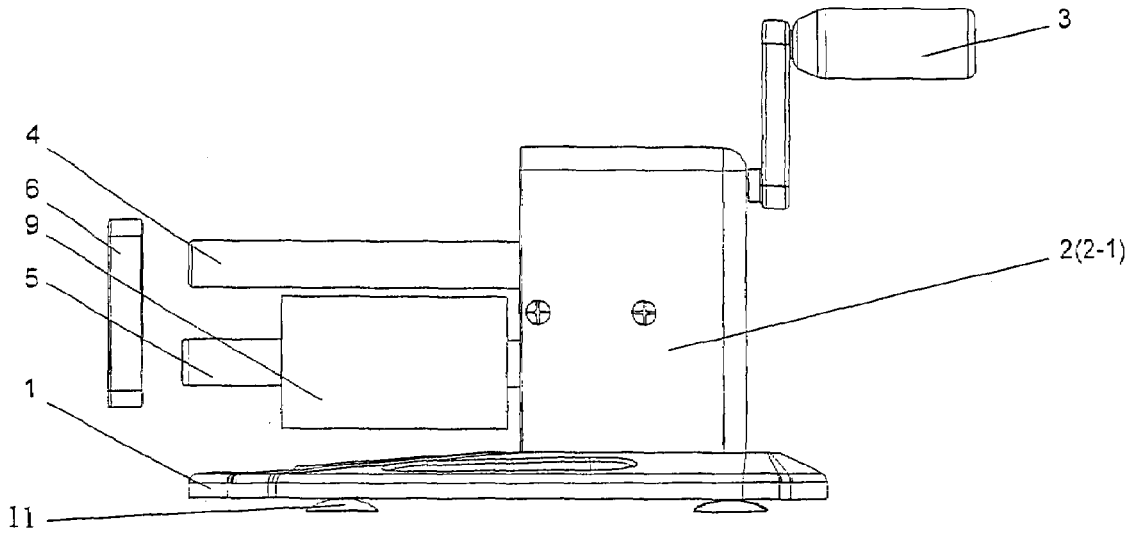
FIG. 3 is a sketch showing the structure of this crank roller paper cutting device.
Figure 4:
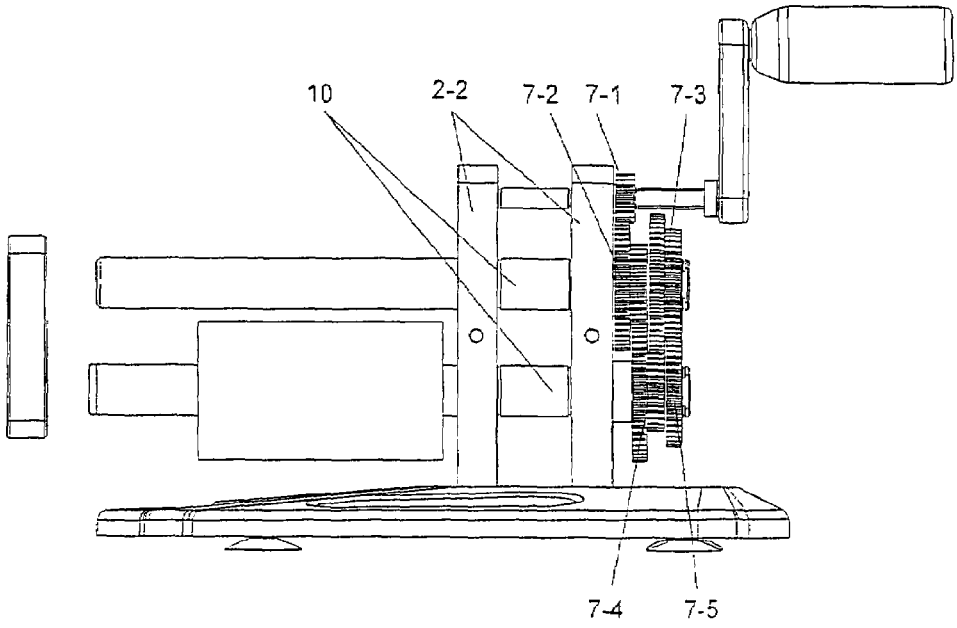
FIG. 4 is a sketch showing the structure of this crank roller paper cutting device after removing the supporter cover.

FIG. 3-4 illustrates the detailed structure of the invention. From FIG. 3, one can see this crank roller paper cutting device comprises a base 1, a supporter 2, a handle stick 3, a master roller 4, a slave roller 5, and a positioning block 6. From FIG. 4, one can see there is also a group of speed reducing gears 7. Via this group of speed-reducing gears 7, the handle part 3 correlates to the master roller 4 and slave roller 5 at one terminal. Both the master roller 4 and slave roller 5 are captured by the open bores therewith on the supporter 2. The other ends of master roller 4 and slave roller 5 are suspended in the air (without supporter), where a removable positioning block 6 is attached. Upon the positioning block 6, there are two open bores in correspondence to the master roller 4 and slave roller 5 respectively. Inside the open bores are bearings 8, and around the master roller 4 or slave roller 5 or both are multiple layer removable regulating cylinders 9.

Figure 5:
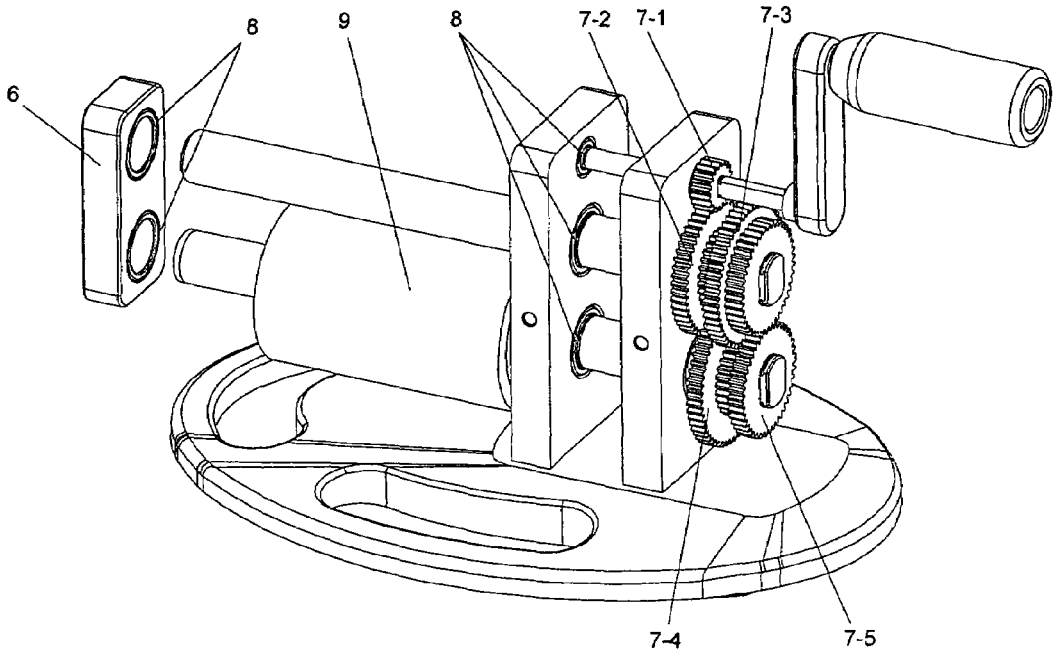
FIG. 5 is a stereograph of this crank roller paper cutting device.

Detailed structure of the speed reducing gear group 7 is illustrated by FIG. 4 and FIG. 5. It includes a gear 7-1, which is relatively fixed in connection to the handle stick 3, a two-scale gear 7-2 (the two-scale gear is composed of two gears in different radius co-axial to the same shaft. Similarly below), which is relatively in sliding connection to the master roller 4, a two-scale gear 7-3, which is relatively fixed in connection to the master roller 4, a two scale gear 7-4, which is relatively in sliding connection to the slave roller 5, and a gear 7-5, which is relatively fixed in connection to the slave roller 5. Interactions among gears are: the gear 7-1 is snapped with the large scale gear of the two-scale gear 7-2, the two-scale gear 7-2 has its small scale gear snapped with the large scale gear of the two-scale gear 7-4, the two-scale gear 7-4 has its small scale gear snapped with the large scale gear of two-scale 7-3, and the two scale gear 7-3 finally has its small scale gear snapped with the gear 7-5.

The supporter 2 consists of a cover 2-1 and two parallel supporting plates 2-2.

Upon the two parallel supporting plates 2-2, there are four open bores matched with each other in two pairs. The master roller 4 and slave roller 5 pierce through the four open bores on the supporting plates 2-2 and both the master roller 4 and slave roller 5 are kept parallel in level, perpendicularly to the two supporting plates 2-2; the portion of master roller 4 and slave roller 5, which is hanged in the space between the two parallel supporting plates 2-2, is held by a positioning ring 10; inside the four open bores on the two supporting plates 2-2 are rotating bearings 8.

Figure 6:
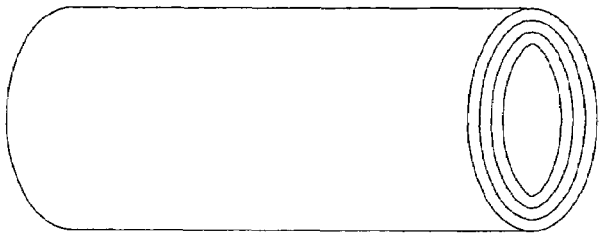
FIG. 6 is a sketch showing the structure of the multiple layer regulation cylinders.

The multiple layer regulation cylinders 9 consist of three difference diameters but same length cylinders inserted one by another. Each cylinder is jointed with each other in sequence. The detailed structure is shown in FIG. 6. The regulation cylinder 9 (that is, the pressing cylinder which contacts with the blade of image cutter) is made of non-rigid materials with certain hardness, like PP. The purpose of choosing this type of material is to avoid damage to the blade of the image cutter while keeping it working properly.

The base 1 has suckers 11 downside as FIG. 3 shows. The role of the suckers is to cause this device to stick to the operation table with no movement in order to ensure it functions normally. The sucker 11 can be made of plastic (i.e. PVC) or rubber.

The principle of the invention is: by wheeling handle stick 3 with hand, gear 7-1 rotates. The rotating gear 7-1 snap-drives the two-scale gear 7-2 consequently (but at that time, gear 7-2 does not drive the master roller 4.) The two-scale gear 7-2, in turn, drives the two-scale gear 7-4 (but at that time, gear 7-4 does not drive the slave roller 5). The two-scale gear 7-4 later drives the two-scale gear 7-3, which, the two-scale gear 7-3, drives master roller 4 to rotate finally. In addition to this, two-scale gear 7-3 also drives gear 7-5 at the same time, which (the gear 7-5) subsequently drives the slave roller 5 to rotate in the opposite direction to the master roller 4. From then on, place the image cutter into the space between master roller 4 and slave roller 5. The rotating master roller 4 and slave roller 5 shall carry the image cutter rolling over the space between the two rollers and the blade of the cutter squeezed by the master roller 4 and slave roller 5 shall scissor the inside flat material into a shape of the blade, such as a letter, cartoon, animal or human image.

EXAMPLE 2

Figure 7:
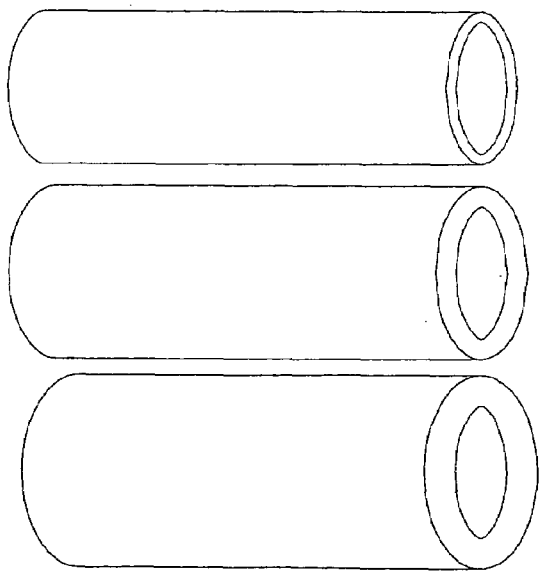
FIG. 7 is a sketch showing the structure of another regulation cylinder.

Another embodiment is identical to figures 3 and 4, except that: around the master roller 4 or slave roller 5 or both, there is a single layer regulation cylinder 9 with different thickness; the different thickness cylinder 9 forms a series of regulation cylinders, as FIG. 7 shows. Once applying a type of image cutter in certain thickness, just select a regulation cylinder 9 in the same thickness and put it on to the master roller 4 or slave roller 5; in case of using another image cutter, merely change to another regulation cylinder 9 with different thickness.

While the above description is conceived to be the most practical embodiments for this invention, it is recognized that this invention is not limited to the examples disclosed above. Any departures, such as alternation, modification or substitution, which are made therefrom within the scope of the invention, are regarded as equivalent replacement thereof and shall be embraced in the protection rang of this invention.

The invention claimed is:

1. A crank roller paper cutting device, comprising:

a base;

a support coupled to said base and extending upwardly therefrom;

a crank handle rotatably coupled to said support having a first gear rotatable thereby;

a master roller having a first end rotatably coupled to said support and a second free end;

a slave roller having a first end rotatably coupled to said support and a second free end;

a removable positioning block coupled to said free ends of said master roller and slave roller, said block supporting the free ends of said master and slaver rollers to maintain said master and slave rollers in a substantially parallel relationship; and a plurality of speed reducing gears coupled to said crank handle, said master roller and said slave roller, said plurality of speed reducing gears including a first gear fixed relative to said crank handle, a first two-scale gear slideably connected relative to said master roller, a second two-scale gear fixed relative to said master roller, a third two-scale gear slideably connected relative to said slave roller, and a second gear fixed relative to said slave roller, the first gear engaging a larger gear of said first two-scale gear, a smaller gear of said first two-scale gear engaging a larger gear of said third-two-scale gear, a smaller gear of said third two-scale gear engaging a larger gear of said second two-scale gear and a larger gear of said second two-scale gear engaging said second gear.

2. The crank roller paper cutting device of claim 1, further comprising at least one removeable sleeve positionable on at least one of said master roller and said slave roller for changing the relative distance between an outside surfaces of said master and slave rollers.

3. The crank roller paper cutting device of claim 1, wherein said support is comprised of a pair of spaced apart parallel supporting plates, each support plate having two open bores in matching arrangement, said master and slave rollers extending through said open bores in said pair of parallel support plates to maintain said master and slave rollers in parallel relationship.

4. The crank roller paper cutting device of claim 3, wherein portions of said master roller and said slave roller that extend between the pair of spaced apart parallel supporting plates are held by positioning rings.

5. The crank roller paper cutting device of claim 3, further comprising bearings mounted within said open bores of said parallel supporting plates.

6. The crank roller paper cutting device of claim 1, wherein said crank handle includes a hand wheel or a hand stick.

7. The crank roller paper cutting device of claim 1, wherein said removable positioning block defines a pair of openings, each for receiving one of said free ends of said master roller and said slaver roller, and further including a pair of rotating bearing, one bearing mounted inside each of said pair of openings.

8. The crank roller paper cutting device of claim 2, wherein said at least one sleeve comprises a plurality of sleeves, each having the same length but different outer diameters with the plurality of sleeves inserted within each other from smallest to biggest.

9. The crank roller paper cutting device of claim 8, wherein said plurality of sleeves are formed from a non-rigid material.

10. The crank roller paper cutting device of claim 1, further comprising a plurality of suction cups attached to a bottom of said base for maintaining the position of said base when placed on a surface.

11. A crank roller paper cutting device, comprising:

a base;

a support coupled to said base and extending upwardly therefrom;

a crank handle rotatably coupled to said support having a first gear rotatable thereby;

a master roller having a first end rotatably coupled to said support and a second end;

a slave roller having a first end rotatably coupled to said support and a second end;

a positioning block coupled to said second ends of said master roller and slave roller, said block maintaining said master and slave rollers in substantially parallel relationship with a substantially uniform distance between outside surfaces of said master and slave rollers; and a plurality of removeable cylindrical sleeves positionable on at least one of said master roller and said slave roller for selectively changing the relative distance between said outside surfaces of said master and slave rollers, each of said plurality of removeable cylindrical sleeves having the same length but different outer diameters.

12. The crank roller of claim 11, wherein said positioning block is removable from said second ends of said master roller and slave roller.

13. The crank roller paper cutting device of claim 11, further comprising a plurality of speed reducing gears coupled to said crank handle, said master roller and said slave roller, said plurality of speed reducing gears including a first gear fixed relative to said crank handle, a first two-scale gear slideably connected relative to said master roller, a second two-scale gear fixed relative to said master roller, a third two-scale gear slideably connected relative to said slave roller, and a second gear fixed relative to said slave roller, the first gear engaging a larger gear of said first two-scale gear, a smaller gear of said first two-scale gear engaging a larger gear of said third- two-scale gear, a smaller gear of said third two-scale gear engaging a larger gear of said second two-scale gear and a larger gear of said second two-scale gear engaging said second gear.

14. The crank roller paper cutting device of claim 11, wherein said support is comprised of a pair of spaced apart parallel supporting plates, each support plate having two open bores in matching arrangement, said master and slave rollers extending through said open bores in said pair of parallel support plates to maintain said master and slave rollers in parallel relationship.

15. The crank roller paper cutting device of claim 14, wherein portions of said master roller and said slave roller that extend between the pair of spaced apart parallel supporting plates are held by positioning rings.

16. The crank roller paper cutting device of claim 14, further comprising bearings mounted within said open bores of said parallel supporting plates.

17. The crank roller paper cutting device of claim 11, wherein said crank handle includes a hand wheel or a hand stick.

18. The crank roller paper cutting device of claim 11, wherein said positioning block defines a pair of openings, each for receiving one of said free ends of said master roller and said slaver roller, and further including a pair of rotating bearing, one bearing mounted inside each of said pair of openings.

19. The crank roller paper cutting device of claim 11, wherein the plurality of sleeves inserted within each other from smallest to biggest.

20. The crank roller paper cutting device of claim 19, wherein said plurality of sleeves are formed from a non-rigid material.

21. The crank roller paper cutting device of claim 11, further comprising a plurality of suction cups attached to a bottom of said base for maintaining the position of said base when placed on a surface.

* * * * *